US005215393A

United States Patent [19]

Wincent

[11] Patent Number: 5,215,393

[45] Date of Patent: Jun. 1, 1993

[54] DOCUMENT FEEDING DEVICE

[75] Inventor: Tommy Wincent, Upplands Väsby, Sweden

[73] Assignee: Swecoin AB, Sweden

[21] Appl. No.: 886,324

[22] Filed: May 20, 1992

[51] Int. Cl.[5] ..... B41J 11/26

[52] U.S. Cl. ..... 400/621; 101/226; 83/365

[58] Field of Search ..... 101/232, 224, 226, 227; 400/621, 617, 611, 185, 593; 83/360, 365, 370, 371, 372

[56] References Cited

U.S. PATENT DOCUMENTS

| | | | |
|---|---|---|---|
| 3,897,727 | 8/1975 | Fulk | 101/227 |
| 4,216,719 | 8/1980 | Flaceliere et al. | 400/621 |
| 4,572,686 | 2/1986 | Tanaka | 101/226 |

FOREIGN PATENT DOCUMENTS

| | | | |
|---|---|---|---|
| 2912656 | 10/1980 | Fed. Rep. of Germany | 400/621 |
| 2604120 | 3/1988 | France | 400/621 |
| 0208288 | 12/1982 | Japan | 400/621 |
| 0140284 | 8/1983 | Japan | 400/621 |
| 0054585 | 3/1984 | Japan | 400/621 |
| 0227363 | 9/1988 | Japan | 400/621 |

*Primary Examiner*—Eugene H. Eickholt

*Attorney, Agent, or Firm*—Dressler, Goldsmith, Shore, Sutker & Milnamow, Ltd.

[57] ABSTRACT

A device for feeding documents, such as receipts (K) to a receiver from a printing apparatus which prints information on the documents. The device includes means (9-13) which prevents the documents from being fed out and made available to the receiver until all information has been printed on the document, means (2) for making a document, the feeding of which is prevented through an outlet opening (4), unavailable to the receiver, and means (9-12) for transportation of the document to a place where it does not prevent the feeding of further documents through the outlet opening.

5 Claims, 1 Drawing Sheet 1
2
3
4
5
6
7
8
8a
9
10
11
12
13
14
14a
15
16
18
19
20
21
22
23
24
P
P1
P2
K 2
3
4
5
7
8
8a
9
10
11
12
13
14a
18
19
20
22
23
P
K

DOCUMENT FEEDING DEVICE

TECHNICAL FIELD

The present invention refers to a device for feeding documents, such as receipts, to a receiver from a printing apparatus which provides the documents with information.

BACKGROUND ART

Parking meters, gasoline pumps, cash-dispensers and similar machines are often provided with devices which print information on a receipt and feed the receipt to the customer who keeps it as a verification of the service or the article he has bought.

It is well known that these printing and feeding devices will sometimes get out of order, often owing to the fact that the customer either tries to remove the receipt from the device before it has been printed and separated from a slip or blocks the outlet opening of the device. Attempts to remove the receipt during the printing operation or during the separation may damage the printing device and the separation device which lead to it either that these devices cannot be used before having been repaired or that the receipt will be defective or illegible. Blocking the outlet opening of the device may lead to it that the receipt will get caught in the device and prevents the feeding of additional receipts or may lead to it that the device will be damaged.

If the printing and feeding devices are out of order the subsequent customer will not get the service or article he has bought or he will not get a correct receipt or will not get a receipt at all. Moreover, the devices must be repaired.

DISCLOSURE OF THE INVENTION

It is the main object of the present invention to at least partially circumvent the disadvantages of previously known feeding devices.

By the invention a device is achieved which makes the feeding of a document out to a customer possible before the document has been completely printed and severed from a slip and/or which can continue to feed correct documents in spite of the fact that the outlet opening of the device has been blocked during a previous feeding-out operation.

The above object is fulfilled by the device according to the invention having the features specified in the claims.

DESCRIPTION OF PREFERRED EMBODIMENT

Figure 1:
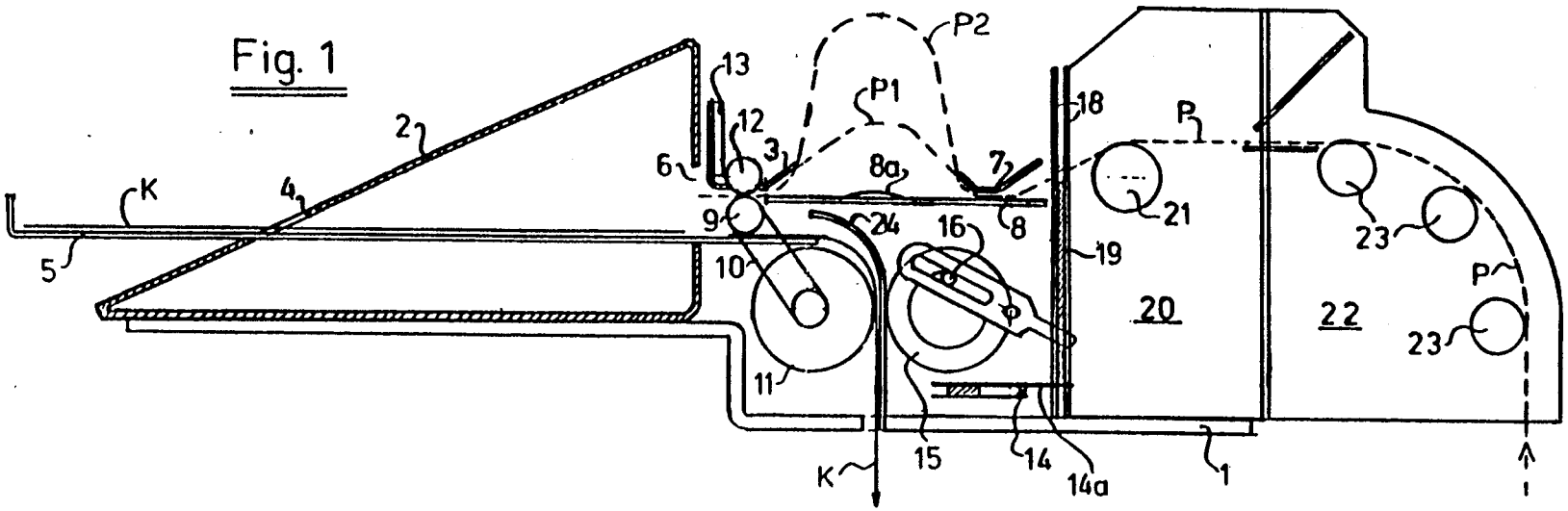
Figure 2:
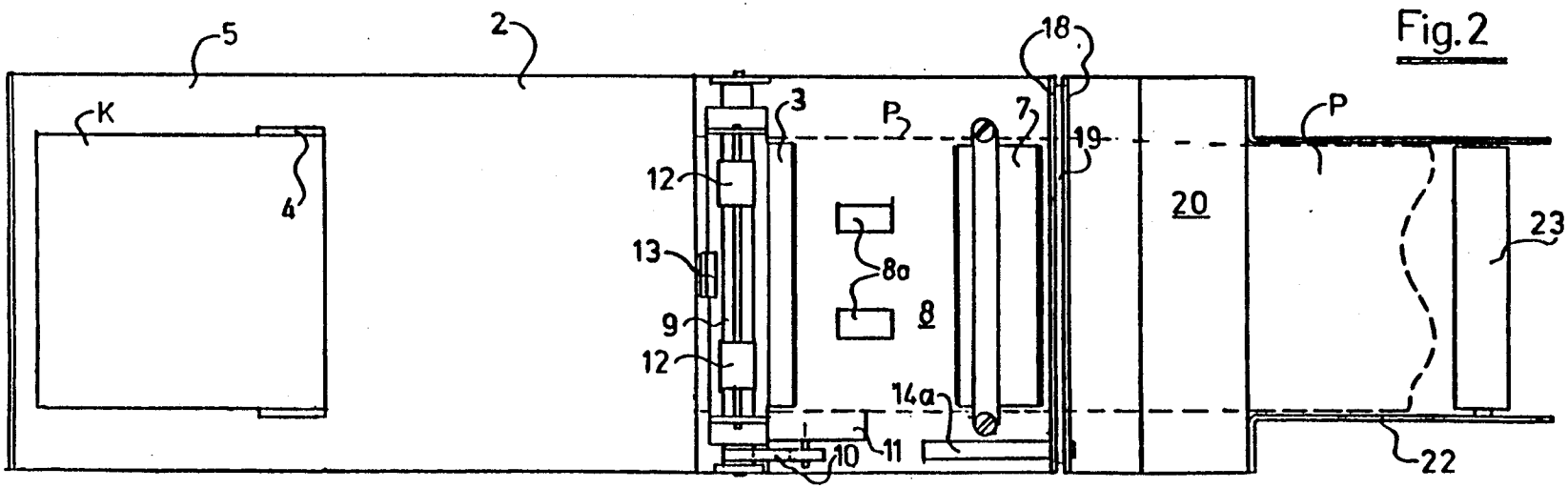

A preferred embodiment of the invention will now be described in conjunction with the drawings in which FIG. 1 is a schematic, partly sectional view of a device according to the present invention, and FIG. 2 is a view seen from above and partly in section of the device shown in FIG. 1.

The device shown in FIGS. 1 and 2 is a unit which is intended to be mounted on or in connection with a gasoline pump, parking meter, cash-dispenser or a similar apparatus. The device is connected to the apparatus in such a manner that it receives information therefrom in the form of electric signals in order to eject a receipt to a customer which is provided with printed information about the bought service or article.

The device is especially useful in connection with the above mentioned apparatuses because the customer himself and not an experienced skilled man in the art removes the receipt from the device.

In the following description and claims the expressions "front" and "rear" are used which correspond to "nearest" and "furthest away from", respectively, i.e. "to the left" and "to the right", respectively, in FIGS. 1 and 2.

The device in FIGS. 1 and 2 includes a frame 1 on which the components of the device are mounted. A cover 2 with an outlet opening 4 is attached to the frame 1. A supporting plate 5 having an end edge upfolded is attached to the device so that its left portion protrudes through the opening 4 and its right portion protrudes through an opening 6 in the right end wall of the cover 2.

Two guide plates 3 and 7, each one having a front and a rear upfolded end edge, are attached to the frame 1 to the right of the cover 2. A bottom plate 8 having two raised portions 8*a* is attached below the guide plates 3 and 7 so that a gap having a thickness of approximately 1 mm is formed between the bottom plate and each one of the guide plates. A roller 9 having a high friction layer is rotatably supported in the frame 1 and is driven counter-clockwise via a belt 10 by an electric motor 11. Two rollers 12 having low friction layers are rotatably supported in the frame 1 above the roller 9 and is in contact therewith. An optical sensor 13 is attached on the upfolded left end edge of the guide plate 3 and is connected to the motor via electric wires not shown.

Adjacent to the motor 11 there is one more electric motor 15 which operates the severing or cutting device comprising two fixed vertical guide plates 18 and a cutting blade 19 therebetween. The motor 15 is coupled to the cutting blade 19 via an excentric motion transferring device 16 to move the blade upwards and downwards when the motor is rotating. An electric switch 14 is attached to the frame 1 so that a movable portion 14*a* thereof protrudes in the gap between the guide plates 18 to be acted on by the blade 19 and thus close the switch 14 when the blade is in its lower position. The switch 14 is connected to the motor 11 via electrical wires not shown.

A curved guide plate 24 is attached to the frame 1 between the motors 11 and 15. The upper portion of the plate 24 extends partly above and is at a distance from the right portion of the supporting plate 5.

A conventional printing device 20 is mounted to the right of the cutting device 18, 19 to print information on a document. The printing device 20 i.a. includes a roller 21 which feeds documents step by step to the left in FIGS. 1 and 2.

A portion 22 of the device for feeding a paper slip P to the printing device 20 i.a. includes guide rollers 23. The slip P is mounted on a freely rotatable roll (not shown) and is fed via the rollers 23 by means of and past the printing device 20 to the left in FIGS. 1 and 2 to be cut by the cutting device 18, 19 and thus divided in a document, such as a receipt K and a remaining portion of the slip P.

The function of the device of the invention will now be described.

In the initial position of the device the left end edge of the slip P is located between the guide plates 18 where a receipt previously has been cut from the slip by the cutting blade 19. The blade 19 is in its lower position where it closes the switch 14.

When a receipt is to be printed the printing device 20 is started which prints information on the slip P during its movement step by step to the left between the plates 3, 7 and 8 by the roller 21. The motor 11 is rotated simultaneously. When the left end edge of the slip P reaches the nip between the roller 9 and the rollers 12 the end edge thereof is gripped by these rollers and is fed further to the left until the end edge actuates the sensor 13 which sends a signal to the motor 11 to stop. When the motor is stopped the feeding of the slip P by means of the roller 9 is ceased. The roller 9 together with the rollers 12, however, hold the left end edge of the slip.

During the further feeding of the slip P to the left by means of the roller 21 the slip will be bent upwardly which is facilitated by means of the raised portions 8*a*. The bending is continued until the printing operation has come to an end and the feeding of the slip P by means of the roller 21 has been stopped. The longer the extent of the printed information in the longitudinal direction of the slip P, the more the slip will bend. In FIG. 1 it is shown by dashed lines P1 and P2 that the slip P has been bent to differently shaped loops.

When the printing is stopped the motor receives an impuls from the printing device 20 to start rotating. The blade 19 will then be moved upwards and cuts off the slip P at a location between the roller 21 and the guide plate 7 so that a receipt K is severed from the slip. During this movement the blade breaks the current through the switch 14 which sends an impuls to the motor 11 to start immediately after the cutting operation has come to an end.

The motor 11 rotates the roller 9 which cooperates with the rollers 12 to feed the receipt K to the cover 2 and out on the supporting plate 5. The distance between the opening 4 and the roller 9 is so chosen that the shortest receipt length always exceeds this distance. This means that also the shortest receipt will be available to the receiver outside the cover.

The receipt feeding operation is continued until the sensor 13 detects that the receipt has left the area below it. Then the sensor 13 sends a signal to the motor 11 to stop.

The resetting of the cutting device 18, 19 and the switch 14 to their initial positions described above does not need to be described because such is evident for a person skilled in the art.

To gain time but still making the slip feeding operation safe the motor 11 can be controlled to rotate with low velocity when the left end edge of the slip P is fed to the sensor 13 and rotate with high velocity when the cut receipt is fed out into the cover 2.

If the opening 4 in the cover 2 is blocked so that the receipt K will not be fed out therethrough this will not cause any other inconveniences than preventing the customer from receiving the receipt. When the opening 4 is blocked and the right end edge of the receipt K disengages the rollers 9 and 12 the roller 9 will force the end edge downwardly because the roller is rotating counter-clockwise and is covered with high friction material. The roller 9 continues to rotate as long as the sensor 13 senses that the receipt K is present below it. During this rotation the roller 9 forces the right end edge of the receipt K to a position under the roller to be supported by the supporting plate 5 which is mounted at a distance from the roller 9 corresponding to the thickness of the receipt. During the continuous rotation the roller 9 feeds the receipt K along the plate 5, above the right edge of the plate 5 and, by guidance by means of the guiding plate 24, to a place below the frame 1 where the receipt is not available to the customer.

When the left end edge of the receipt K has passed below the sensor 13 and left the roller 9 the motor 11 is stopped. Thereafter, the printing of a new receipt can be started and finished and the receipt be fed out without being prevented by the previously printed and blocked receipt.

An embodiment of the device according to the present invention has now been described and shown on the drawings. It should be noted, however, that the invention is not limited to this embodiment but only is restricted to that which is stated in the claims.

I claim:

1. A device for feeding documents, such as receipts, to a receiver from a printing apparatus which prints information on the documents, the device including means for preventing each document from being fed out and made available to the receiver until all information has been printed thereon;

means for preventing each document from being fed out until it has left the printing apparatus and has been severed from a slip by a severing device;

means for making possible the bending of the document to form a loop as a part of the slip during its feeding operation out from the printing apparatus, and means for retaining a front portion of the slip, so that said portion will not be available to the receiver during said feeding operation.

2. A device according to claim 1, wherein the retaining means are provided to cooperate with drive means for feeding documents out to the receiver.

3. A device according to claim 2, wherein the drive means include rollers, the document being driven therethrough by rotating at least one of the rollers when the document has left the printing apparatus and the severing device.

4. A device according to claim 2, wherein a sensor is arranged in front of one of the retaining means and the drive means, the sensor being engaged by a front portion of the document to engage the drive means.

5. A device according to claim 2, wherein one of the printing apparatus and the severing device engages the drive means for feeding out the document after printing and severing, respectively.

* * * * *

US005215393B1

REEXAMINATION CERTIFICATE (3652th)

United States Patent [19] [11] B1 5,215,393

Wincent [45] Certificate Issued Oct. 27, 1998

[54] DOCUMENT FEEDING DEVICE

[75] Inventor: Tommy Wincent, Upplands Väsby, Sweden

[73] Assignee: Swecoin AB, Sundbyberg, Sweden

Reexamination Request:
No. 90/004,887, Jan. 8, 1998

Reexamination Certificate for:

| | |
|---|---|
| Patent No.: | **5,215,393** |
| Issued: | **Jun. 1, 1993** |
| Appl. No.: | **886,324** |
| Filed: | **May 20, 1992** |

[51] Int. Cl.[6] ..... B41J 11/26
[52] U.S. Cl. ..... 400/621; 101/226; 83/365
[58] Field of Search ..... 101/232, 224, 101/226, 227; 400/621, 617, 611, 185, 593; 83/360, 365, 370, 371, 372

[56] References Cited

U.S. PATENT DOCUMENTS

| | | | |
|---|---|---|---|
| 3,897,727 | 8/1975 | Fulk | 101/227 |
| 4,216,719 | 8/1980 | Flaceliere et al. | 400/621 |
| 4,572,686 | 2/1986 | Tanaka | 101/226 |

FOREIGN PATENT DOCUMENTS

| | | | |
|---|---|---|---|
| 2604120 | 3/1988 | France | 400/621 |
| 2912656 | 10/1980 | Germany | 400/621 |
| 0208288 | 12/1982 | Japan | 400/621 |
| 0140284 | 8/1983 | Japan | 400/621 |
| 0054585 | 3/1984 | Japan | 400/621 |
| 0227363 | 9/1988 | Japan | 400/621 |
| 1-181659 | 7/1989 | Japan . | |

*Primary Examiner*—Eugene H. Eickholt

[57] ABSTRACT

A device for feeding documents, such as receipts (K) to a receiver from a printing apparatus which prints information on the documents. The device includes means (9–13) which prevents the documents from being fed out and made available to the receiver until all information has been printed on the document, means (2) for making a document, the feeding of which is prevented through an outlet opening (4), unavailable to the receiver, and means (9–12) for transportation of the document to a place where it does not prevent the feeding of further documents through the outlet opening.

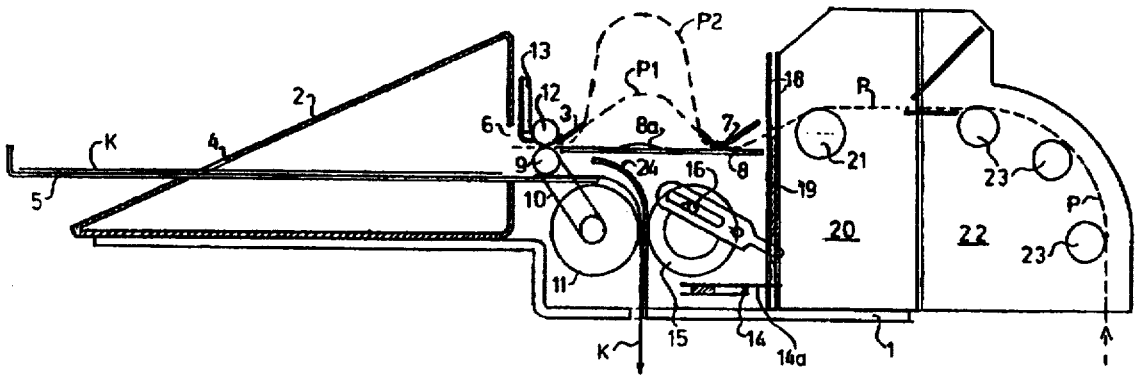

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–5 is confirmed.

* * * * *